US011285489B2

(12) United States Patent
Miller et al.

(10) Patent No.: US 11,285,489 B2
(45) Date of Patent: Mar. 29, 2022

(54) MILLING OILFIELD PARTICULATES

(71) Applicant: Halliburton Energy Services, Inc., Houston, TX (US)

(72) Inventors: Jeffrey J. Miller, Spring, TX (US); Henry Magne Hakstad, Stavanger (NO); Chris L. Bosch, Houston, TX (US); Johannes Rygg, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 158 days.

(21) Appl. No.: 16/326,325

(22) PCT Filed: Sep. 29, 2016

(86) PCT No.: PCT/US2016/054329
§ 371 (c)(1),
(2) Date: Feb. 18, 2019

(87) PCT Pub. No.: WO2018/063212
PCT Pub. Date: Apr. 5, 2018

(65) Prior Publication Data

US 2019/0262839 A1 Aug. 29, 2019

(51) Int. Cl.
*B02C 19/06* (2006.01)
*B02C 19/18* (2006.01)
*B02C 23/12* (2006.01)

(52) U.S. Cl.
CPC ..... *B02C 19/06* (2013.01); *B02C 19/18* (2013.01); *B02C 23/12* (2013.01)

(58) Field of Classification Search
CPC ..... B02C 19/06; B02C 19/18; B02C 23/12
See application file for complete search history.

(56) References Cited

U.S. PATENT DOCUMENTS

| | | | | |
|---|---|---|---|---|
| 2006/0102390 | A1 | 5/2006 | Burnett et al. | |
| 2008/0107513 | A1 | 5/2008 | Curtis et al. | |
| 2011/0283758 | A1 | 11/2011 | Carin et al. | |
| 2013/0289137 | A1 | 10/2013 | Ortalano | |
| 2014/0014000 | A1* | 1/2014 | Franzen | B02C 19/0056 106/273.1 |
| 2014/0332391 | A1 | 11/2014 | Munisteri | |
| 2016/0045841 | A1* | 2/2016 | Kaplan | B01D 3/06 429/49 |
| 2019/0134643 | A1* | 5/2019 | Medoff | B02C 7/17 |

FOREIGN PATENT DOCUMENTS

| | | |
|---|---|---|
| WO | 2008033591 | 3/2008 |
| WO | 2016044688 | 3/2016 |

OTHER PUBLICATIONS

ISRWO International Search Report and Written Opinion for PCT/US2016/054329 dated Jun. 15, 2017.

* cited by examiner

*Primary Examiner* — Faye Francis
(74) *Attorney, Agent, or Firm* — Tenley Krueger; C. Tumey Law Group PLLC

(57) ABSTRACT

The embodiments of the present disclosure relate generally to subterranean formation operations and, more particularly, to milling oilfield particulates for use in subterranean formation operations. The embodiments provide systems and methods which may include jet mills that can be customized to grind desirably sized crude oilfield particulates, thereby creating operational oilfield particulates, and containerized for ease of use, movement, and shipping.

20 Claims, 9 Drawing Sheets

MILLING OILFIELD PARTICULATES

BACKGROUND

The embodiments herein relate generally to subterranean formation operations and, more particularly, to milling oilfield particulates for use in subterranean formation operations.

Treatment fluids comprising various solid oilfield particulates are often used in performing subterranean formation operations, such as drilling operations, completion operations (e.g., perforation operations, stimulation operations, and the like), production operations, enhanced oil recovery operations, and the like, and any combination thereof. As used herein, the term "treatment fluid," and grammatical variants thereof, refers generally to any fluid that may be used in a subterranean application in conjunction with a desired function and/or for a desired purpose. The term "treatment fluid" does not imply any particular action by the fluid or any component thereof. As used herein, the term "oilfield particulate," and grammatical variants thereof, refers to any solid particulate used during a subterranean formation operation as part of an oil and/or gas recovery process, including use in injection wells. The term "oilfield particulate" does not imply any particular action by the particulate, size of the particulate, or shape of the particulate.

In certain subterranean formation operations, such solid oilfield particulates must be ground to a particular size and/or shape to be suitable for use in a particular treatment fluid. In traditional processes, such oilfield particulates are ground using stationary grinding equipment having ball or roller mills that are not well suited for grinding small sized or customized sized oilfield particulates. The footprint of such stationary grinding equipment is large and complex, requiring large facilities to house them. Accordingly, any ground material must be shipped to well sites for use in treatment fluids for performing formation operations, which are typically first stored in bulk in silos and/or packaging facilities. Further, the stationary grinding equipment utilizes moving parts, which creates dust from the grinding process, thereby creating environmental and personnel hazards.

BRIEF DESCRIPTION OF THE DRAWINGS

The following figures are included to illustrate certain aspects of the embodiments described herein, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
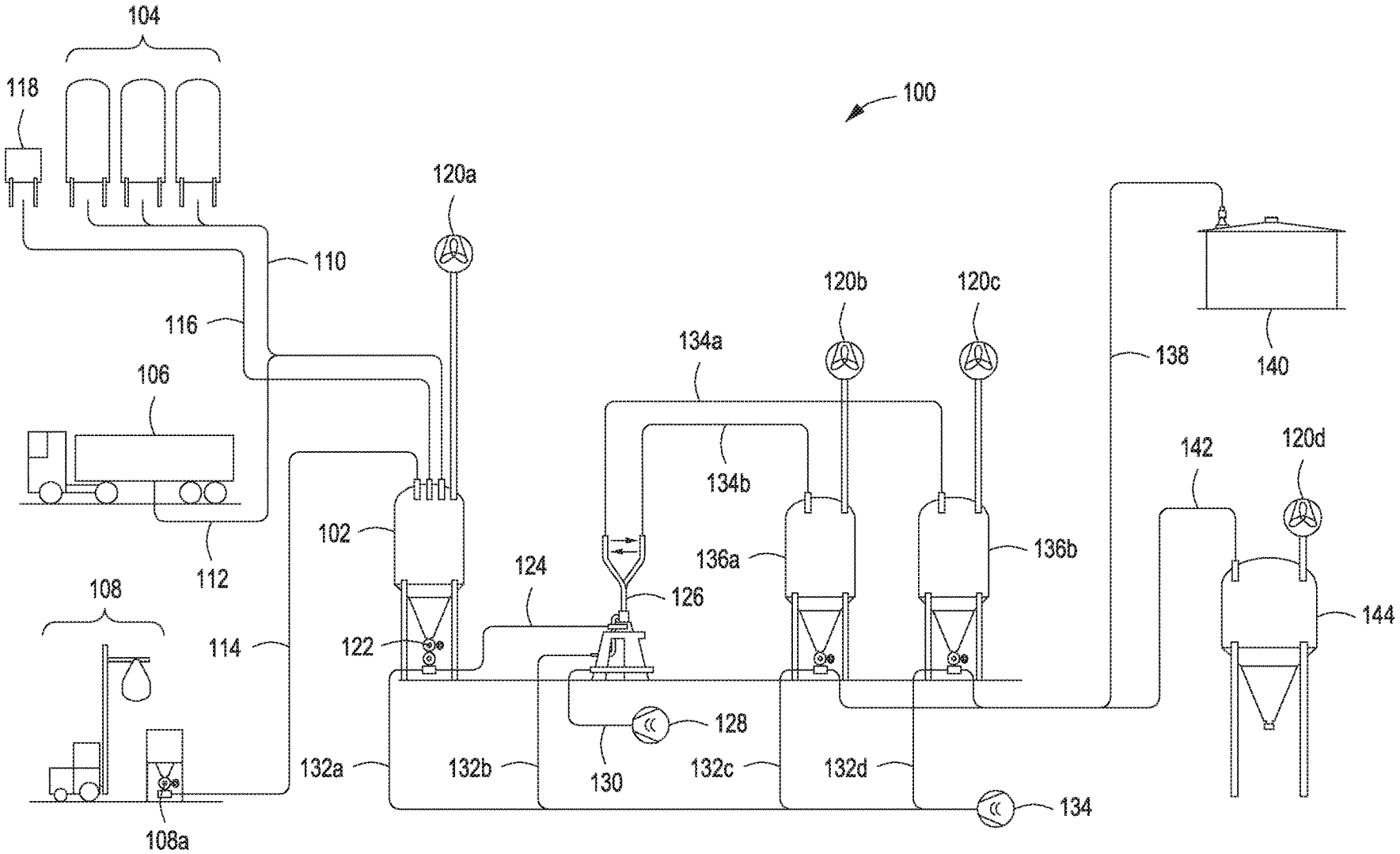
FIG. 1 illustrates an example system employing a jet mill for grinding crude oilfield particulates into operational oilfield particulates, according to one or more embodiments of the present disclosure.

The embodiments herein relate generally to subterranean formation operations and, more particularly, to milling oilfield particulates for use in subterranean formation operations.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of a numerical value. For example, if the numerical value is "about 5," the range of 4.75 to 5.25 is encompassed. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used in relation to the illustrative embodiments as they are depicted in the figures herein, the upward direction being toward the top of the corresponding figure and the downward direction being toward the bottom of the corresponding figure, the uphole direction being toward the surface of the well and the downhole direction being toward the toe of the well. Additionally, the embodiments depicted in the figures herein are not necessarily to scale and certain features are shown in schematic form only or are exaggerated or minimized in scale in the interest of clarity.

The embodiments of the present disclosure provide systems and methods comprising jet mills that can be customized to grind desirably sized crude oilfield particulates, thereby creating operational oilfield particulates. As used herein, the term "jet mill," and grammatical variants thereof, refers to a machine capable of grinding solid particulates using a high speed jet of compressed air or inert gas to impact the particulates together. As used herein, the term "crude oilfield particulates," and grammatical variants thereof, refers to oilfield particulates that exist naturally or have been pre-ground (e.g., using traditional stationary grinding equipment) to have an average unit mesh size in the range of about 25 micrometers (μm) to about 1.1 millimeters (mm), encompassing any value and subset therebetween. The term "unit mesh size," and grammatical variants thereof, refers to a size of an object (e.g., an oilfield particulate) that is able to pass through a square area having each side thereof equal to a specified numerical value. The term "operational oilfield particulates," and grammatical variants thereof, refers to oilfield particulates that have been jet milled to a desirable size for use in a particular subterranean formation operation treatment fluid. The operational oilfield particulates have an average unit mesh size that is less than that of the crude oilfield particulates and, in some embodiments, have an average unit mesh size in the range of about 0.5 μm to about 25 μm, encompassing any value and subset therebetween. It is to be understood, however, that the jet mills described herein are able to produce larger sized operational oilfield particulates if needed for a particular operation, including any size smaller than the largest size of crude oilfield particulates described herein, without departing from the scope of the present disclosure.

The jet mills described herein are particularly well suited for grinding customized small size crude oilfield particulates, which are held in a chamber subjected to the air or inert gas until such customized size is achieved. They further have a small footprint and can be containerized to be mobile, allowing grinding at well sites, mixing facilities, or any other location, which may significantly decrease excess particulate stock or inventory. Accordingly, in some embodiments, the jet mills described herein form part of a system for reducing the size of crude oilfield particulates and the jet mill machine itself may be immobile or mobile, or containerized to be mobile for transport and/or shipment. Indeed, the size and customization of the jet mills described herein may permit immediate customer input and immediate customization to oilfield particulates to meet changing well requirements, for example. In some embodiments, the footprint of the jet mill may be less than about 2.5 meters (m) by less than about 2.5 m, without departing from the scope of the present disclosure. In some embodiments, the footprint of the jet mill may be less than about 2.5 meters (m) to greater than about 1.5 m by less than about 2.5 m to greater than about 1.5 m, encompassing any value and subset therebetween. Additionally, because the jet mills utilize air or inert gasses to grind the crude oilfield particulates, the formation of dust due to the grinding process is minimized, thereby decreasing hazards associated with such dust and reducing waste.

In some embodiments, the present disclosure provides for a system comprising a feed tank containing crude oilfield particulates having a first average unit mesh size. A jet mill is fluidly coupled to the feed tank by a feed conveyance capable of conveying the crude oilfield particulates to the jet mill. The jet mill reduces the size of the crude oilfield particulates to a second average unit mesh size that is smaller than the first average unit mesh size, thereby producing operational oilfield particulates. Thereafter, an output conveyance is fluidly coupled to the jet mill and is capable of conveying the operational oilfield particulates to a target location. Accordingly, the present disclosure provides methods of conveying crude oilfield particulates from a feed tank to a jet mill by a feed conveyance fluidly coupling the feed tank and the jet mill, and the crude oilfield particulates have a first average unit mesh size. The jet mill then reduces the size of the crude oilfield particulates to a second average unit mesh size that is smaller than the first average unit, thereby forming operational oilfield particulates. Thereafter, the operational oilfield particulates are conveyed from the jet mill to a target location by an output conveyance fluidly coupled to the jet mill.

As used herein, the term "feed tank," and grammatical variants thereof, refers to any storage container capable of receiving and housing crude oilfield particulates, as described herein. The term "fluidly coupled," and grammatical variants thereof, refers to a connection between two components or equipment that permits flow (e.g., of fluid and/or solids) therebetween. As used herein, the term "conveyance," and grammatical variants thereof, refers to tubular (e.g., line) capable of transporting or communicating the oilfield particulates (alone or in a fluid, such as a treatment fluid) from one location to another. The term "target location," and grammatical variants thereof, as used herein, refers to the immediate or near-immediate location in which the operational oilfield particulates are placed. The "target location" does not imply the later movement or later/final use and placement of the operational oilfield particulates. For example, examples of target locations in accordance with the embodiments described herein include, but are not limited to, a storage tank, a mixing tank, a fluid line, a conveyor belt, a bag filler (e.g., a big bag filler), a fluid stream entering a wellbore, and any combination thereof.

As described above, the crude oilfield particulates may be pre-ground or naturally found having an average unit mesh size in the range of about 25 micrometers (μm) to about 1.1 millimeters (mm), encompassing any value and subset therebetween. This size range allows the jet mill described herein to adequately reduce the size of the crude oilfield particulates to form the operational oilfield particulates described herein. That is, the jet mill may form operational particulates that have an average unit mesh size any size smaller than 1.1 mm, without departing from the scope of the present disclosure. In some embodiments, the operational oilfield particulates have an average unit mesh size in the range of about 0.5 μm to about 25 μm, encompassing any value and subset therebetween. In some embodiments, the jet mill has a processing rate of reducing the size of the crude oilfield particulates to produce the operational oilfield particulates of greater than about 2000 kilograms per hour (kg/hr). In more particular embodiments, the jet mill has a processing rate of reducing the size of the crude oilfield particulates to produce the operational oilfield particulates in the range of about 2000 kg/hr to about 4000 kg/hr, encompassing any value and subset therebetween.

The oilfield particulates may be any solid particulates used in a treatment fluid for performing a subterranean formation operation. Examples of such oilfield particulates may include, but are not limited to, a weighting agent, a bridging agent, a lost circulation material, a proppant particulate, a gravel particulate, a degradable particulate, a mined mineral oilfield additive, a treated mined mineral additive, a chemical powder, a cement particulate, and the like, and any combination thereof. The embodiments described herein thus allow customized sizes for such materials in an on-demand fashion, thereby allowing customer customization and quick response to well site demands, particularly since the jet mills described herein may be present at the well site itself.

In some instances, the ideal size of an operational oilfield particulate may be dictated by the particular subterranean formation being treated, or the particular assemblies and/or equipment (e.g., drilling and/or completion assemblies) that are to be installed within the formation. For example, sizes for calcium carbonate operational oilfield particulates used as a bridging agent may be dictated by the pore throat sizes of the particular formation. Operational oilfield particulates for use in plugging or remediating fissures, faults, fractures, or other openings may utilize smaller particulates in combination with larger particulates to achieve adequate plugging. Again, the size of the operational oilfield particulates for such uses would be dictated by the size of such openings and the desired degree of plugging to be achieved.

For example, in some embodiments, the crude oilfield particulates may be a weighting agent of barium sulfate (barite). Typical barite is ground (e.g., using stationary grinding equipment) to a 200 mesh size, U.S. Sieve Series, in accordance the American Petroleum Institute (API) standard, which is equivalent to about 74 μm. At such a size, the crude barite may be used "as is" for less demanding treatment fluids, for example in surface and/or overburden sections of a wellbore. As the wellbore is drilled during a drilling operation to reach hydrocarbon-rich reservoirs, the conditions within the subterranean formation may become more challenging, requiring smaller sized weighting agents. These smaller weighting agents may be required for suspension in low equivalent circulating density (ECD) treatment fluid systems. For instance, in drilling operations, treatment fluids must generate minimal viscosity so the ECD does not become excessive, while providing suspension for weighting agent oilfield particulates to ensure well pressure is stabilized. Additionally, these smaller weighting agents may be required to enable passing the weighting agents through production screens or geometric restrictions in other well completion equipment to complete a reservoir portion of a wellbore.

The systems and methods described herein employing a small footprint, containerizable, mobile (or immobile) jet mill can be used to "dial in" and select appropriately sized weighting agents based on the demands of a particular operation, whether at a mixing facility or at the well site. Such immediate or near-immediate ability to obtain appropriately sized weighting agents (or other operational oilfield particulates) lessens the need for shipping costs and onsite storage requirements because they can be produced much closer to end use locations in accordance with the present disclosure. For example, such small sized oilfield particulates typically require large bags for transport and specialized mixing equipment to minimize safety risks and losses of material to the environment, including mixing them into a slurry. However, the current disclosure lessens the production expense and transport/bulk storage issues typically associated with small sized oilfield particulates, as described herein.

More particularly, in one embodiment pertaining to weighting agent oilfield particulates of barite, crude barite is initially mined from natural deposits and shipped to stationary grinding facilities. The barite ore is ground to a nominal 200-mesh API standard size, with any grit that does not meet this size being discarded. In some instances, a subterranean operation may require use of the crude barite (200-mesh). If reduced sized barite particulates are required, the jet mill described herein, either at the well site or at a mixing facility (which may be nearby), is set to produce the required size of operational barite particulates. Custom sizes may be produced accurately with the jet mill by introducing a particle size analysis detector with feedback loop to the jet mill controls, for example. If the jet mill is located at the well site, they may be used immediately in a treatment fluid for performing a particular operation. If the jet mill is located at a mixing facility, the custom sized operational barite particulates may be packaged in containers (e.g., bags) in the desired amount (e.g., what is required by a particular operation or in greater bulk) and shipped to the well site (or drilling fluid mixing facilities, stock-points, and the like).

If the jet mill is located at the well site (including onshore and/or offshore platforms or rigs), even more immediate customization of crude oilfield particulates could be obtained. For example, the jet mill may be located at the hub of activity of a drilling operation, such as a liquid mud plant. In some instances, stock of crude oilfield particulates may be stored at the well site for use in required size customization depending on the demands of a particular operation, thereby imparting the capability to rapidly mobilize variable operational scheduled (e.g., based on global demands). The crude oilfield particulates would simply serve as common bulk stock, whether at the well site or other storage facilities, and multiple sized oilfield particulates would not be required. Moreover, the systems and methods described herein allow for deployment of jet mills for use in customizing crude oilfield particulates in areas lacking methods of production. Further, local production of treatment fluids comprising operational oilfield particulates also enhances the capability to provide local content because the jet mill is portable and can be located at wellsites, for example.

As described in greater detail below, the size and shape of the jet mills used in accordance with the embodiments described herein allow for their containment in shipping containers for integration into modular, mobile mixing facilities, for example. The containerization further allows the jet mill to be easily and safely shipped from one location to another on an as-needed basis. Additional equipment associated with the jet mill, such as air compressors, can also be housed in such shipping containers for easy transport.

Referring now to FIG. 1, illustrated is an example system employing a jet mill, according to one or more embodiments of the present disclosure. The grinding system 100 is merely one embodiment, and it is to be appreciated that other configurations are possible or other components or equipment may be included, without departing from the scope of the present disclosure. As shown, crude oilfield particulates are introduced into a feed tank 102 by one or more input mechanisms. As shown, three potential input mechanisms are shown as silos 104, trailer 106, and bag cutter 108. While three mechanisms are shown, any one, two, or all of the mechanisms may be used for delivering crude oilfield particulates into the feed tank 102, without departing from the scope of the present disclosure. Moreover, other mechanisms may also be used alone or in combination with the depicted mechanisms for delivering the crude oilfield particulates into the feed tank 102, without departing from the scope of the present disclosure.

The silos 104 contain bulk oilfield particulates that have been delivered and placed into the silos 104 for storage and use. The silos 104 have a conveyance 110 that conveys the oilfield particulates to the feed tank 102. Although three silos 104 are shown, it is to be appreciated that less than three (one or two) silos may be present or a greater number than three may be present, without departing from the scope of the present disclosure. The trailer 106 may be any truck or other automobile for delivering crude oilfield products directly to the system 1. A conveyance 112 conveys the crude oilfield particulates from the trailer 106 to the feed tank 102. Although one trailer 106 is shown in FIG. 1, it is to be appreciated that greater than one trailer may be used to deliver crude oilfield particulates to the feed tank 102, without departing from the scope of the present disclosure. As a third example, the crude oilfield particulates may be delivered to the feed tank 102 by one or more bag cutters 108, where the crude oilfield particulates are brought to the bag cutter in large bags and are then cut by the bag cutter 108 and introduced into a tank 108*a*. From the tank 108*a*, a conveyance 114 conveys the crude oilfield particulates to the feed tank 102.

As shown, the feed tank 102 has two input areas (not labeled) for receiving the conveyances from the three input mechanisms, but any number (one or more than three) may be used in accordance with the particular system, without departing from the scope of the present disclosure. Each of the conveyances 110, 112, 114 may be pressurized and may be of a size, for example having a diameter in the range of about 3 inches (in) to about 5 in or any other suitable size, without departing from the scope of the present disclosure. One or more vent lines 116 (one shown) may be used to vent dust particles or other airborne solids created by the crude oilfield particulates and not meeting the crude oilfield particulate unit mesh size range. The vent line 116 may fluidly couple the feed tank 102 to a dust filter 118. For additional air pollution control, one or more production filters 120*a-d* (e.g., pulse-jet fabric filters) may be used throughout the system 100. Although four production filters 120*a-d* are shown, fewer or more may be used, without departing from the scope of the present disclosure, to control air pollution (e.g., dust creation). For example, such production filters 120*a-d* may be fluidly coupled to any or all tanks in the system 100.

With continued reference to FIG. 1, the crude oilfield particulates may pass through a rotary valve 122 from the feed tank 102 to a feed conveyance 124 fluidly coupling the feed tank 102 and a jet mill 126. That is, the jet mill 126 and the feed tank 102 are fluidly coupled via the feed conveyance 124, and the feed conveyance line 124 is capable of conveying the crude oilfield particulates to the jet mill 126. The jet mill 126 is able to reduce the size of the crude oilfield particulates using compressed air or inert gas, thereby forming operational oilfield particulates. For example a compressor 128 may be fluidly coupled to the jet mill 126 via a grinding air line 130. A series of rinsing air lines 132*a-d* may further be used throughout the system 100 to couple another compressor 134 to one or more tanks used throughout the system 100 (e.g., as shown, but not limited to, the feed tank 102, the jet mill 126, and one or more target locations described below). The compressors may be hot or cold compressors, for example. In one embodiment, a hot compressor may be used for for grinding the crude oilfield particulates with the jet mill 126, and a cold compressor may be used to convey the crude oilfield particulates from the feed tank 102 and/or for maintaining the temperature of other components of the configuration 100, without departing from the scope of the present disclosure.

After being ground to the desirable size using the jet mill 126, the operational oilfield particulates are conveyed indirectly or directly to a desired target location via one or more output conveyance lines. As shown, the operational oilfield particulates are conveyed via one of two output conveyances 134*a,b* directly to two separate storage tanks 136*a,b*. The output conveyances 134*a,b* may fluidly couple to the jet mill 126 via a swivel to allow selection of the desired storage tank 136*a,b* (e.g., once one is full). It is to be noted that although two output conveyances 134*a,b* are shown, one or greater than two may be used in the system 100, without departing from the scope of the present disclosure. Similarly, although two storage tank 136*a,b* target locations are shown, one or greater than two may be used in the system 100, without departing from the scope of the present disclosure.

As shown, additional target locations may be reached indirectly for conveying the operational oilfield particulates from the jet mill 126. For example, one or both of the output conveyances 134*a,b* may convey the operational oilfield particulates to one or more storage tank 136*a,b* target locations and thereafter a series of additional output conveyance lines convey the operational oilfield particulates to a subsequent target location. For example, as shown, the operational oilfield particulates may be conveyed from the one or more storage tank 136*a,b* target locations via output conveyance line 138 fluidly coupled to one or more mixing tanks 140 (one shown) target locations, or via output conveyance line 142 fluidly coupled to one or more bag filler 144 (one shown) target locations. It is to be appreciated that an output conveyance could directly or indirectly (e.g., flowing first through a storage tank) fluidly couple the jet mill 126 to any one or more desired target location, without departing from the scope of the present disclosure. Examples of suitable target locations may include, but are not limited to, a storage tank, a mixing tank (i.e., housing pre-mixed compositions or final treatment fluid compositions for introduction into a wellbore), a fluid line (i.e., having flowing fluid therein), a conveyor belt, a bag filler, a fluid stream entering a wellbore, and any combination thereof.

As previously stated, the jet mill described in the instant disclosure may be containerized to allow its easy mobilization or shipment relative to a feed tank for grinding crude oilfield particulates therein. In some embodiments, the feed tank itself may additionally be containerized with the jet mill to permit their mobilization or shipment together. In yet other embodiments, the feed tank, the jet mill, and one or more target locations are containerized for mobilization or shipment together. Accordingly, in some embodiments, only the jet mill is containerized, but in other instances, a greater portion of the system 100 (FIG. 1) is containerized, without departing from the scope of the present disclosure.

Figure 2:
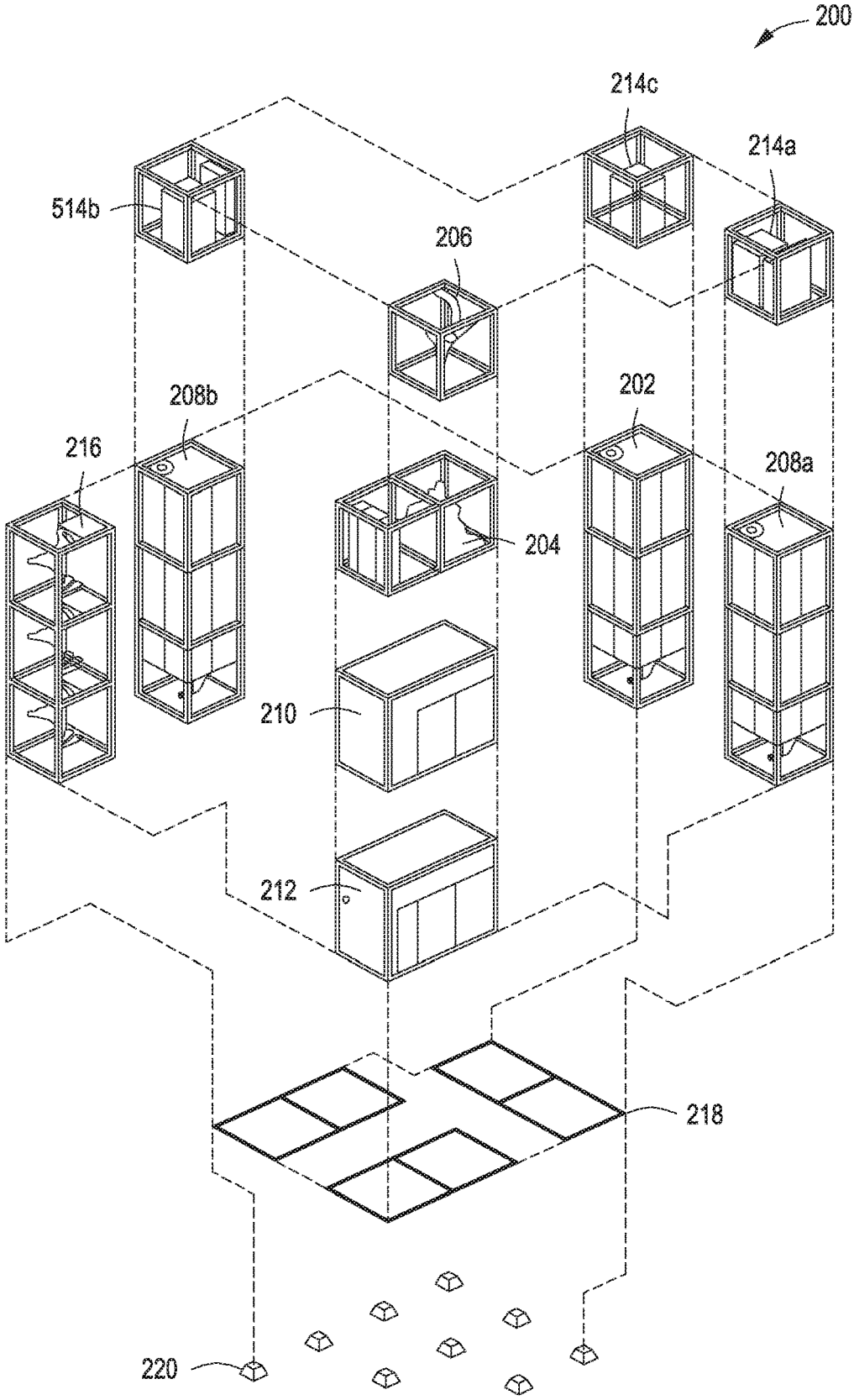
FIG. 2 illustrates an exploded view of a standard containerized configuration comprising a feed tank and two storage tank target locations, according to one or more embodiments of the present disclosure.

As examples, the present disclosure provides a basic containerized configuration, a standard containerized configuration, and a full containerized configuration. The basic containerized configuration comprises a feed tank, a jet mill, and a storage tank (target location), which may be substantially similar or identical to those in FIG. 1. The standard containerized configuration comprises a feed tank, a jet mill, and two storage tank (target locations), which may also be substantially similar or identical to those in FIG. 1. The full containerized configuration comprises six tanks in the combination of either three feed tanks and three storage tanks (target locations) or two feed tanks and four storage tanks (target locations), and a jet mill. For ease of reference for each of the containerized configurations, FIG. 2 illustrates an exploded view of a standard containerized configuration, according to one or more embodiments of the present disclosure. For further illustration, the isometric and planar views for each additional configuration type are additionally provided and described herein below.

Referring to FIG. 2, an exploded view of a standard containerized configuration 200, according to one or more embodiments of the present disclosure is shown. The configuration 200 comprises one feed tank 202 for housing crude oilfield particulates. In some embodiments, the feed tank 202 may have a volume of about 35 cubic meters ($m^3$), although other volumes may additionally be used in accordance with the embodiments described herein, without departing from the scope of the present disclosure. The feed conveyance described above is not shown, but would be fluidly coupled to the jet mill 204 to convey the crude oilfield particulates thereto. As shown, next to the jet mill 204 and containerized therewith, although they may be separately containerized, are three control panels (not labeled) for operation of the compressors 128, 134 (FIG. 1) and the jet mill 204. The jet mill 204 grinds the crude oilfield particulates to produce the operational oilfield particulates described herein. The jet mill 204 has a swivel attachment 206 for fluidly coupling to an output conveyance (not shown) to convey the operational oilfield particulates to one of the two storage tanks 208*a,b* (target locations), as selected by an operator or computer, for example. Similar to the feed tank 202, the storage tanks 208*a,b* (target locations) may have a volume of about 35 $m^3$, although other volumes may additionally be used in accordance with the embodiments described herein, without departing from the scope of the present disclosure.

Additional components to the configuration 200 may include, but are not limited to, a compressor 210, 212 used for grinding, conveying the crude oilfield particulates from the feed tank 202, and/or maintaining the temperature of the configuration, as described above. Further components may include, but are not limited to, production dust filters 214*c* for alleviating environmental dust contamination from the feed tank 202, and 214*a,b* for alleviating environmental dust contamination from the storage tanks 208*a,b*, respectively. Stairs 216 may be used to access certain the components of the configuration 200. However, the stairs 216 (and any other stairs described herein with reference to other configurations (e.g., stairs 416 and 516 described below) may be optional, such as where access is not needed due to other access means or where the footprint of the configuration must be minimized. A position frame 218 may be used to position each of the various components of the configuration 200 into single unit, movable or shippable together. It will be appreciated that additional framing may be used, as shown, to house each of the individual components separately or in any combination with one another, without departing from the scope of the present disclosure. The position frame 218 and any other framing used may be composed of a rigid material capable of supporting the weight of the configuration 200 or its various components, such as a metal, a hard metal alloy, a hard plastic, a cement, a ceramic, and the like, and any combination thereof. As shown, foundation footing 220 may be used to facilitate placement of the configuration 200 into a particular system, or to adjust the configuration 200 to level, for example.

Figure 3A:
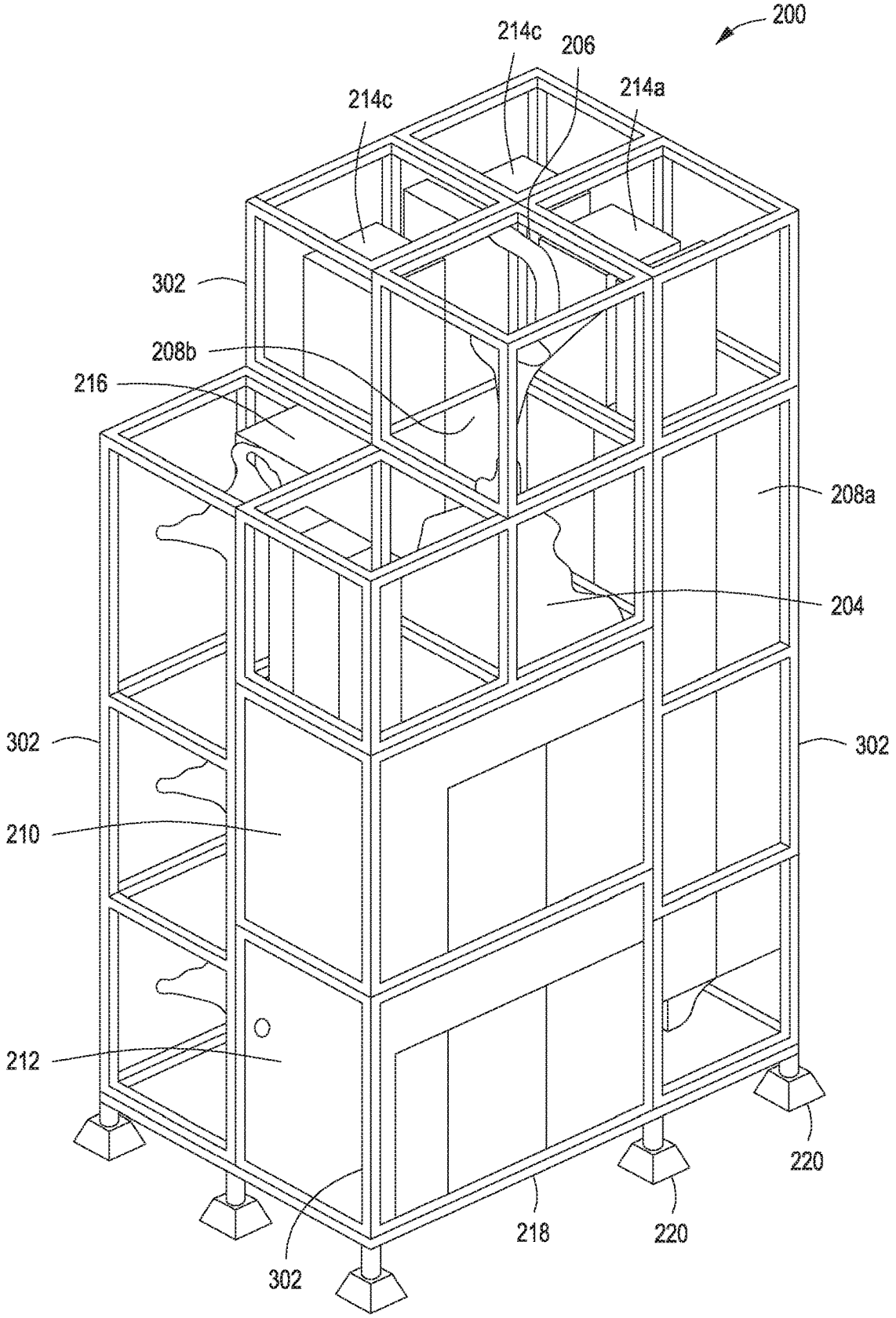
FIGS. 3A-3D illustrate various non-exploded views of a standard containerized configuration comprising a feed tank and two storage tank target locations, according to one or more embodiments of the present disclosure.
Figure 3B:
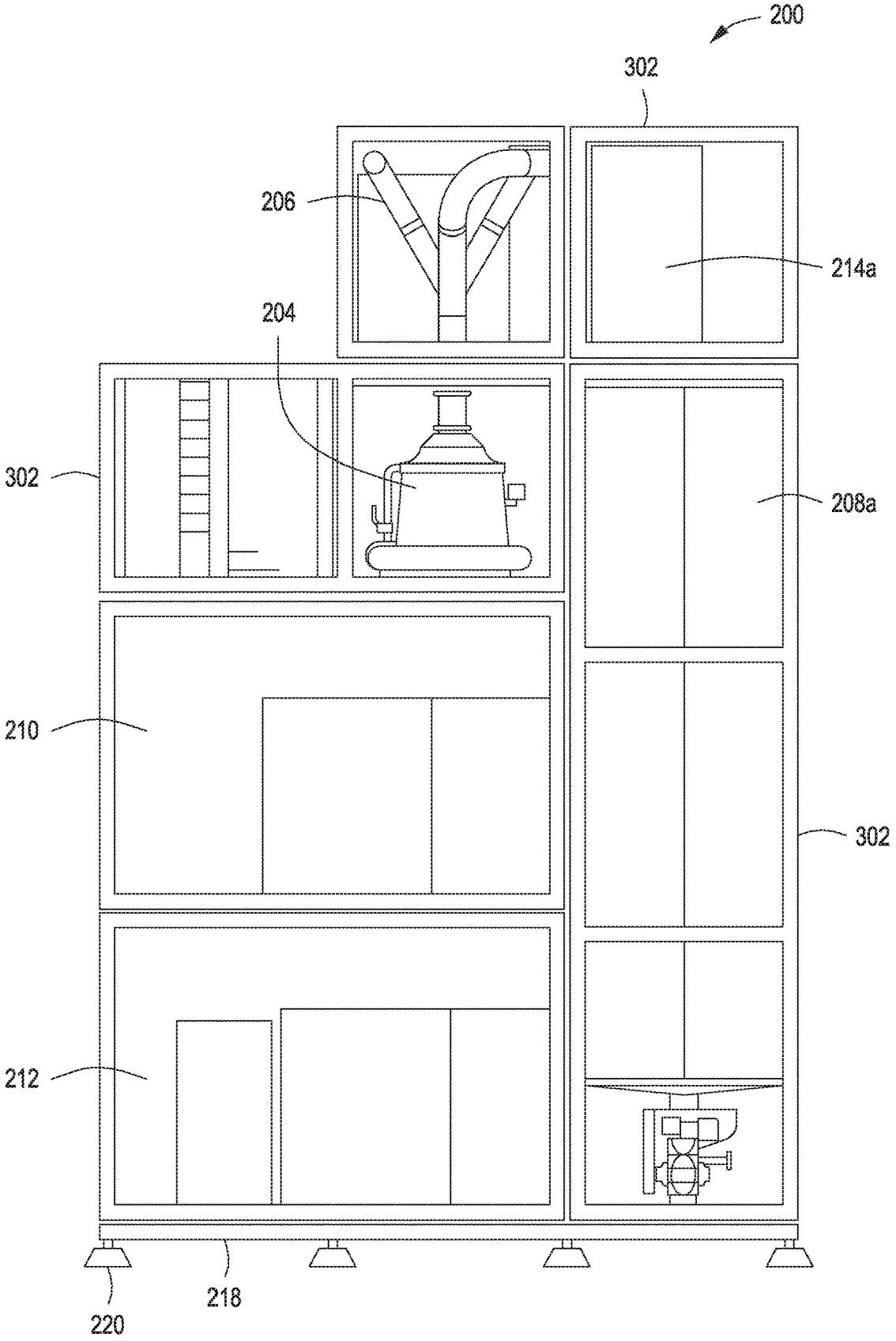
Figure 3C:
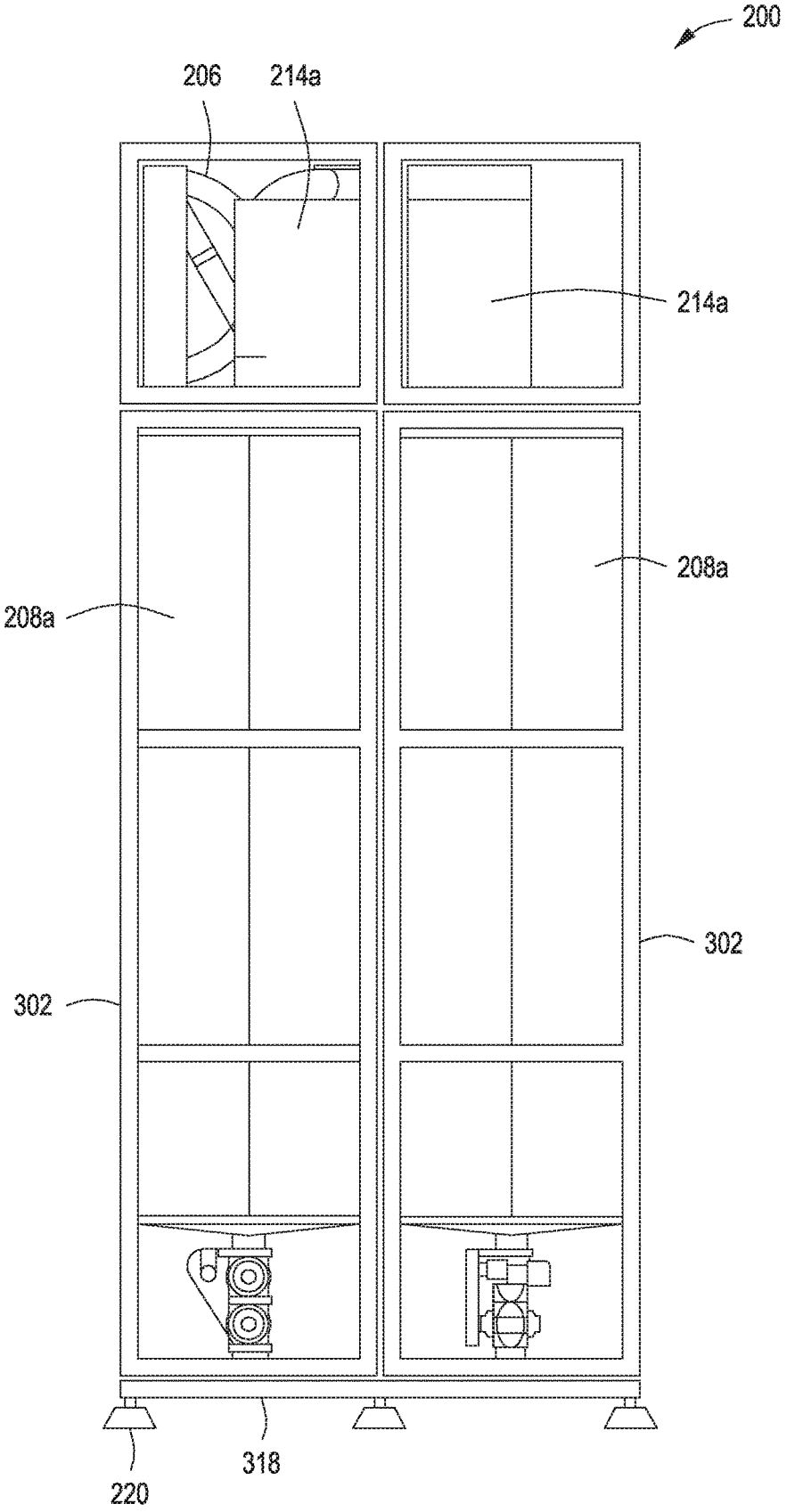
Figure 3D:
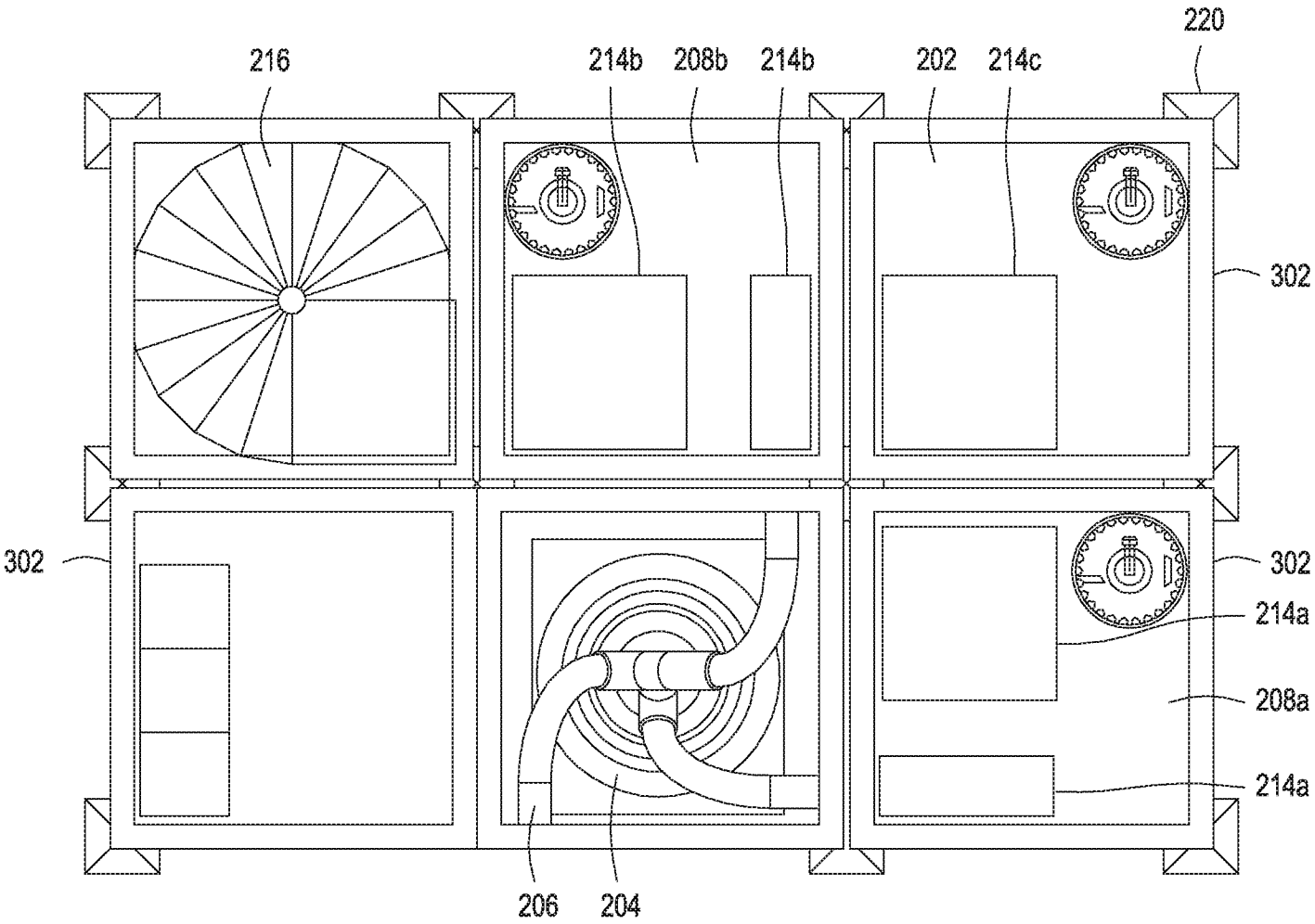

Referring now to FIGS. 3A-3D, with continued reference to FIG. 2 including labeling nomenclature, illustrated are various non-exploded views of the standard containerized configuration 200, according to one or more embodiments of the present disclosure. FIG. 3A is a perspective view of the configuration 200 of FIG. 2. The various components are visible, including the jet mill 204, the swivel attachment 206, the storage tanks 208*a,b* (target locations), the compressors 210, 212, the dust filters 214*a-c*, stairs 216, position frame 218, and foundation footing 220. Additional framing 302 are also shown, as described above. The feed tank 202 is not shown in FIG. 3A, but can be seen in FIGS. 3B-3C showing different perspectives of the configuration 200 of FIG. 2. Specifically, FIG. 3B shows a front view of the standard containerized configuration of FIG. 2; FIG. 3C is a lateral view of the standard containerized configuration of FIG. 2; and FIG. 3D is a plan view of the standard containerized configuration of FIG. 2. Components that can be seen are labeled accordingly, with reference to FIGS. 2 and 3A.

Figure 4A:
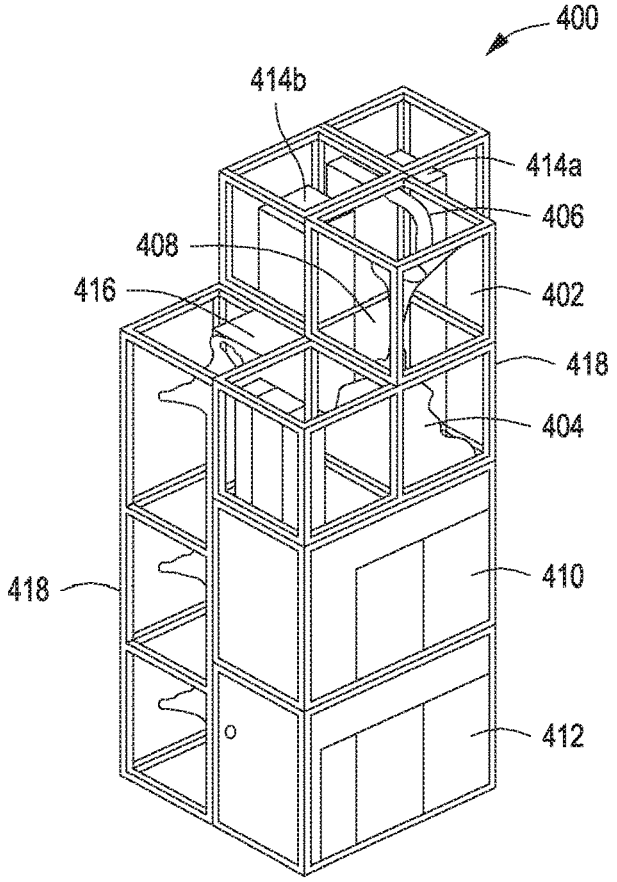
FIGS. 4A and 4B illustrate various non-exploded views of a basic containerized configuration comprising a feed tank and a storage tank target locations, according to one or more embodiments of the present disclosure.
Figure 4B:
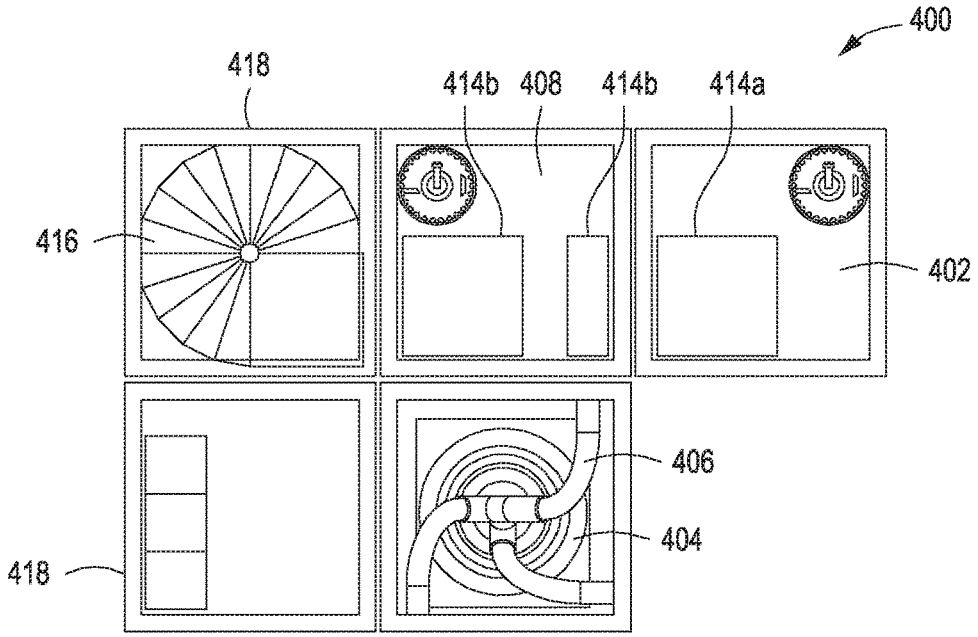

As previously stated, the basic containerized configuration comprises a feed tank, a jet mill, and a storage tank (target location). FIGS. 4A and 4B, with continued reference to FIG. 2, illustrate various non-exploded views of a basic containerized configuration 400, according to one or more embodiments of the present disclosure. FIG. 4A is a perspective view of configuration 400 and FIG. 4B is a plan view of configuration 400. As shown in FIGS. 4A and 4B, configuration 400 comprises a feed tank 402, a jet mill 404, a swivel attachment 406 to the jet mill 404, a storage tank 408 (target location), a compressor 410, a compressor 412, dust filter 414*a* for alleviating environmental dust contamination from the feed tank 402, dust filter 414*b* for alleviating environmental dust contamination from the storage tank 408, stairs 416, and additional framing 418. Additional components described in FIGS. 2 and 3A may additionally be included, such as a position frame and foundation footing, without departing from the scope of the present disclosure.

As previously stated, the basic containerized configuration comprises a feed tank, a jet mill, and a storage tank (target location). FIGS. 4A and 4B, with continued reference to FIG. 2 and FIG. 3A, illustrate various non-exploded views of a basic containerized configuration 400, according to one or more embodiments of the present disclosure. FIG. 4A is a perspective view of configuration 400 and FIG. 4B is a plan view of configuration 400. As shown in FIGS. 4A and 4B collectively, configuration 400 comprises a feed tank 402, a jet mill 404, a swivel attachment 406 to the jet mill 404, a storage tank 408 (target location), compressors 410, 412, dust filter 414*a* for alleviating environmental dust contamination from the feed tank 402, dust filter 414*b* for alleviating environmental dust contamination from the storage tank 408, stairs 416, and additional framing 418. Additional components described in FIGS. 2 and 3A may additionally be included, such as a position frame and foundation footing, without departing from the scope of the present disclosure.

Figure 5A:
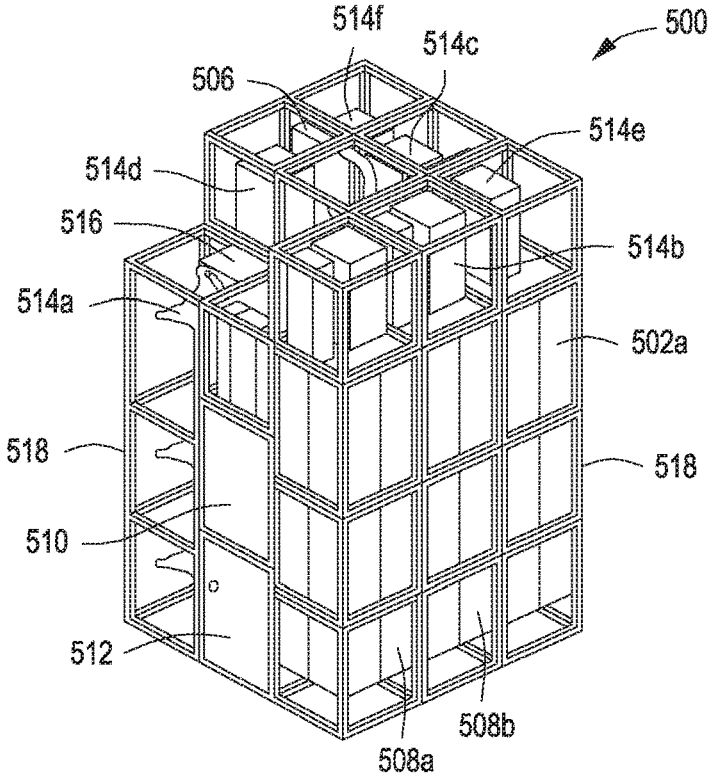
FIGS. 5A and 5B illustrate various non-exploded views of a basic containerized configuration comprising a feed tank and a storage tank target locations, according to one or more embodiments of the present disclosure
Figure 5B:
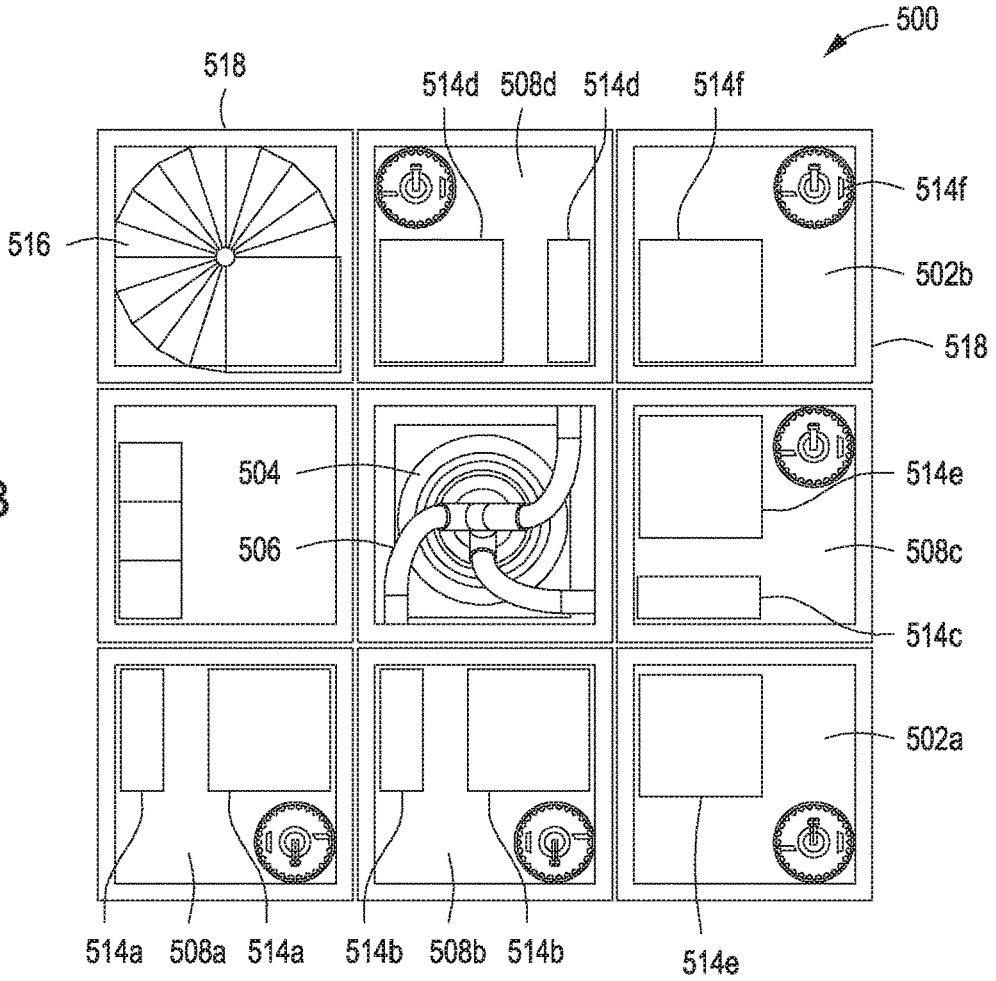

As described above, the full containerized configuration comprises six tanks in the combination of either three feed tanks and three storage tanks (target locations) or two feed tanks and four storage tanks (target locations), and a jet mill. FIGS. 5A and 5B, with continued reference to FIG. 2 and FIG. 3A, illustrate various non-exploded views of a full containerized configuration 500, according to one or more embodiments of the present disclosure. FIG. 5A is a perspective view of configuration 500 and FIG. 5B is a plan view of configuration 500. As shown in FIGS. 5A and 5B collectively, configuration 500 comprises two feed tanks 502*a,b*, a jet mill 504, a swivel attachment 506 to the jet mill 504, four storage tanks 408*a-d* (target location), compressors 510, 512, dust filters 514*e,f* for alleviating environmental dust contamination from the feed tank 502, dust filters 514*a-d* for alleviating environmental dust contamination from the storage tanks 508*a-d*, stairs 516, and additional framing 518. It is to be appreciated that rather than having four storage tanks 408*a-d*, any one may be replaced with a third feed tank in accordance with the full containerized configurations described herein. For example, storage tank 508*a* may be replaced with a third feed tank. Additional components described in FIGS. 2 and 3A may additionally be included, such as a position frame and foundation footing, without departing from the scope of the present disclosure.

The height of each of the basic, standard, or full containerized configurations may be identical, such as in the range of about 7 meters (m) to about 15 m, encompassing any value and subset therebetween. In some embodiments, the height of any one or all of the basic, standard, or full containerized configurations may 9 m. In certain instances, the basic containerized configuration may have a footprint area in the range of about 5 m to about 8 m in any one direction of length and/or width, encompassing any value and subset therebetween. Because the basic configuration has a void portion, that void portion will account for about one-sixth of that footprint area, as shown in FIG. 4B. The standard containerized configuration may have a footprint area in the range of about 7 m to about 11 m in any one direction of length and/or width, encompassing any value and subset therebetween. The full containerized configuration may have a footprint area in the range of about 7 m to about 11 m in any one direction of length and/or width, encompassing any value and subset therebetween. Additionally, as described above, if internal stairs are not required for the operation and maintenance of the particular containerized configuration, they may be omitted, thus reducing the footprint of the particular configuration.

In various embodiments, systems configured for delivering the treatment fluids described herein comprising operational oilfield particulates (referred to simply as "treatment fluids") to a downhole location are described. In various embodiments, the systems can comprise a pump fluidly coupled to a tubular, the tubular containing the treatment fluids described herein. It will be appreciated that while the system described below may be used for delivering any one of the treatment fluids described herein, each treatment fluid is delivered separately into the subterranean formation, unless otherwise indicated.

The pump may be a high pressure pump in some embodiments. As used herein, the term "high pressure pump" will refer to a pump that is capable of delivering a treatment fluid downhole at a pressure of about 1000 psi or greater. A high pressure pump may be used when it is desired to introduce the treatment fluids to a subterranean formation at or above a fracture gradient of the subterranean formation, but it may also be used in cases where fracturing is not desired. In some embodiments, the high pressure pump may be capable of fluidly conveying particulate matter, such as the operational oilfield particulates described herein, into the subterranean formation. Suitable high pressure pumps will be known to one having ordinary skill in the art and may include, but are not limited to, floating piston pumps and positive displacement pumps.

In other embodiments, the pump may be a low pressure pump. As used herein, the term "low pressure pump" will refer to a pump that operates at a pressure of about 1000 psi or less. In some embodiments, a low pressure pump may be fluidly coupled to a high pressure pump that is fluidly coupled to the tubular. That is, in such embodiments, the low pressure pump may be configured to convey the treatment fluids to the high pressure pump. In such embodiments, the low pressure pump may "step up" the pressure of the treatment fluids before reaching the high pressure pump.

In some embodiments, the systems described herein can further comprise a mixing tank that is upstream of the pump and in which the treatment fluids are formulated. In various embodiments, the pump (e.g., a low pressure pump, a high pressure pump, or a combination thereof) may convey the treatment fluids from the mixing tank or other source of the treatment fluids to the tubular. In other embodiments, however, the treatment fluids may be formulated offsite and transported to a worksite (e.g., at a wellsite), in which case the treatment fluid may be introduced to the tubular via the pump directly from its shipping container (e.g., a truck, a railcar, a barge, or the like) or from a transport pipeline. In either case, the treatment fluids may be drawn into the pump, elevated to an appropriate pressure, and then introduced into the tubular for delivery downhole.

Figure 6:
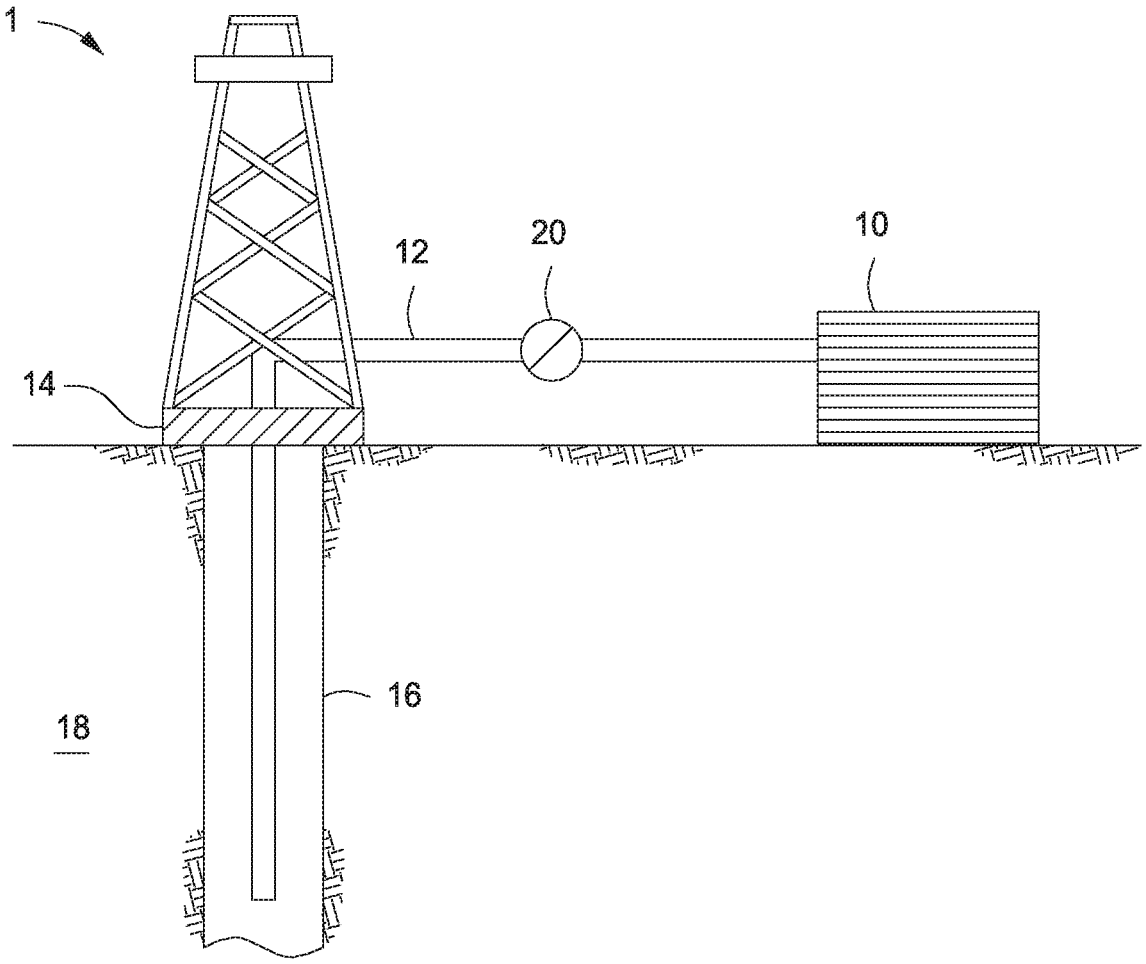
FIG. 6 depicts an embodiment of a system configured for delivering various treatment fluids comprising the operational oilfield particulates of the embodiments described herein to a downhole location, according to one or more embodiments of the present disclosure.

FIG. 6 shows an illustrative schematic of a system that can deliver the treatment fluids (i.e., comprising the operational oilfield particulates) of the present disclosure to a downhole location, according to one or more embodiments. It should be noted that while FIG. 6 generally depicts a land-based system, it is to be recognized that like systems may be operated in subsea locations as well. As depicted in FIG. 6, system 1 may include mixing tank 10, in which the treatment fluids of the embodiments herein may be formulated. The treatment fluids may be conveyed via line 12 to wellhead 14, where the treatment fluids enter tubular 16, tubular 16 extending from wellhead 14 into subterranean formation 18. Upon being ejected from tubular 16, the treatment fluids may subsequently penetrate into subterranean formation 18. Pump 20 may be configured to raise the pressure of the treatment fluids to a desired degree before introduction into tubular 16. It is to be recognized that system 1 is merely exemplary in nature and various additional components may be present that have not necessarily been depicted in FIG. 6 in the interest of clarity. Non-limiting additional components that may be present include, but are not limited to, supply hoppers, valves, condensers, adapters, joints, gauges, sensors, compressors, pressure controllers, pressure sensors, flow rate controllers, flow rate sensors, temperature sensors, and the like.

Although not depicted in FIG. 6, the treatment fluid or a portion thereof may, in some embodiments, flow back to wellhead 14 and exit subterranean formation 18. In some embodiments, the treatment fluid that has flowed back to wellhead 14 may subsequently be recovered and recirculated to subterranean formation 18, or otherwise treated for use in a subsequent subterranean operation or for use in another industry.

It is also to be recognized that the disclosed treatment fluids may also directly or indirectly affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 6.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include:

Embodiment A: A system comprising: a feed tank containing crude oilfield particulates having a first average unit mesh size; a jet mill fluidly coupled to the feed tank by a feed conveyance capable of conveying the crude oilfield particulates to the jet mill, wherein the jet mill reduces a size of the crude oilfield particulates to a second average unit mesh size that is smaller than the first average unit mesh size, thereby forming operational oilfield particulates; an output conveyance fluidly coupled to the jet mill capable of conveying the operational oilfield particulates from the jet mill to a target location.

Embodiment B: A method comprising: conveying crude oilfield particulates from a feed tank to a jet mill by a feed conveyance fluidly coupling the feed tank and the jet mill, wherein the crude oilfield particulates have a first average unit mesh size; reducing a size of the crude oilfield particulates to a second average unit mesh size that is smaller than the first average unit mesh size with the jet mill, thereby forming operational oilfield particulates; conveying the operational oilfield particulates from the jet mill to a target location by an output conveyance fluidly coupled to the jet mill.

Embodiments A and B may have one or more of the following additional elements in any combination:

Element 1: Wherein the target location is selected from the group consisting of a storage tank, a mixing tank, a fluid line, a conveyor belt, a bag filler, a fluid stream entering a wellbore, and any combination thereof.

Element 2: Wherein the jet mill is immobile relative to the feed tank.

Element 3: Wherein the jet mill is portable relative to the feed tank.

Element 4: Wherein at least the jet mill is containerized and portable.

Element 5: Wherein the system is located at a wellsite or at a mixing facility.

Element 6: Wherein the jet mill has a footprint of less than about 2.5 meters by less than about 2.5 meters.

Element 7: Wherein the first average unit mesh size of the crude oilfield particulates is in the range of about 25 micrometers to about 1.1 millimeters.

Element 8: Wherein the second average unit mesh size of the operational oilfield particulates is in the range of about 0.5 micrometers to about 20 micrometers.

Element 9: Wherein the jet mill has a processing rate of reducing the size of the oilfield particulates to the second unit mesh size that is smaller than the first unit mesh size to forming operational oilfield particulates of greater than about 200 kilograms per hour.

By way of non-limiting example, exemplary combinations applicable to A and/or B include: 1-9; 1, 3, and 8; 2 and 9; 4, 6, 7, and 9; 8 and 9; 2, 5, and 7; 5 and 6; and any combination of 1-9 without limitation.

To facilitate a better understanding of the embodiments of the present disclosure, the following examples are given. In no way should the following examples be read to limit, or to define, the scope of the present disclosure.

EXAMPLES

Example 1: In this example, the ability of jet milled crude oilfield particulates of barite having an average (D-50) unit mesh size of 10.9 μm were evaluated for their use in a treatment fluid. The crude oilfield particulates were first ground to form operational oilfield particulates using three rotor speeds of the jet mill: a rotor speed of 8500 revolutions per minute (rpm), a rotor speed of 2800 rpm, and a rotor speed of 2000 rpm, which produced reduced sized barite as shown in Table 1 below.

TABLE 1

| Rotor Speed | Crude Oilfield Particulates (D-50 μm) | Operational Oilfield Particulates (D-50 μm) |
|---|---|---|
| 8500 rpm | 10.9 | 1.2 |
| 2800 rpm | 10.9 | 2.4 |
| 2000 rpm | 10.9 | 2.3 |

As shown, the sizes of the operational oilfield particulates can be fine-tuned using at least the rotor speed of the jet mill described herein. As comparison, a traditional stationary mill, as described above, was used to grind the crude oilfield particulates and a D-50 of 2.3 was achieved, demonstrating the similar effectiveness of traditional stationary mills and jet mills, at least at low rotor speeds of the jet mills.

Using the "jet milled" operational oilfield particulates formed with the jet mill having a rotor speed of 2000 rpm as compared to the stationary mill ground "control" operational oilfield particulates, performance aspects of the particulates were measured in a treatment fluid. The two treatment fluids, one comprising the jet milled operational oilfield particulates ("Jet Milled D-50 TF") and one comprising the control operational oilfield particulates ("Control D-50 TF") were prepared according to Table 2 and dynamically heat aged ("DHA") at 150° F. for 16 hours. These properties were measured before the test fluids were statically heat aged ("SHA") at 350° F. for 120 hours in Fann Model 210285 High Temperature Aging Cells. The cells were sealed and pressurized to 500 psi nitrogen before aging. The density of the two treatment fluids was planned at 16.5 pounds (lb). The units are shown in Table 2; a lab barrel (bbl) is a 350 milliliter small-scale used to simulate a standard oil and gas barrel, which is equivalent to 42 U.S. gallons. Pounds per barrel concentrations of additives, shown as "lb", were scaled to grams. The operational oilfield particulates in the Control D-50 TF were of slightly greater specific gravity than the operational oilfield particulates in the Jet Milled D-50 TF, and thus slightly less were needed in the Control D-50 TF to achieve the same fluid density.

TABLE 2

| Additive | Jet Milled D-50 TF | Control D-50 TF |
|---|---|---|
| Operational Oilfield Particulates | 475 lb | 472 lb |
| Linear Paraffin Base Fluid | 0.53 bbl | 0.53 bbl |
| Emulsifier | 17.5 lb | 17.5 lb |
| Calcium Hydroxide | 4 lb | 4 lb |
| Calcium Chloride Brine (3.65 grams (g) $CaCl_2$ in 20 g $H_2O$) | 0.06 bbl | 0.06 bbl |
| Filtration Control Polymer | 9 lb | 9 lb |
| Suspension Agent(s) | 25 lb | 25 lb |
| Liquid Viscosifier | 0.5 lb | 0.5 lb |

The rheology characteristics of each of the two treatment fluids was tested after either dynamic aging or static aging ("DHA" and "SHA," respectively), as described above. Using a FANN® 35A Viscometer (R1 rotor, B1 bob, and F1 torsion) at 120° F. (~49° C.), measurements of the shear stress of the bob at shear rates between 3 rpm to 600 rpm (units: lb/100 $ft^2$) were taken and the plastic viscosity ("PV") (units: centipoise ("cP")) and the yield point ("YP") (units: lb/100 $ft^2$) were obtained. The PV is determined by subtracting the 300 rpm shear stress from the 600 rpm yield stress. The YP is determined by subtracting the PV from the 300 rpm shear stress.

The 10 second (s) gel and 10 minute (min) gel were measured by allowing each test fluid to remain static for 10-sec or 10-min, respectively, and, then, measuring the maximum deflection at 3 rpm with the FANN® 35A Viscometer (units: lb/100 $ft^2$).

The electrical stability (units: volts) of each treatment fluid was measured using a FANN® Model 23E Electrical Stability Tester at 120° F. (~49° C.) to evaluate the emulsion stability and oil-wetting capacity of the fluids.

For static heat aged samples, the separated top oil was removed with a syringe and measured in milliliters (mL).

For static heat aged samples, the bottom ~75 mL was removed and tested for density (units: pound per gallon (lb/gal)) by transferring to a pressurized measuring vessel (PMV), available from the Fann Instrument Company of Houston, Tex., USA under part number 102432866.

For static heat aged samples, the aggregate density (units: lb/gal) was measured by PMV.

For static heat aged samples, the density variation (units: lb/gal) was measured by subtracting the aggregate density from the bottom ~75 mL density.

The results are provided in Table 3 below and demonstrate that the behavior of the Jet Milled D-50 TF compared to the Controlled D-50 TF are similar, with the performance of the Jet Milled D-50 TF being acceptable or even preferable.

TABLE 3

| | Jet Milled D-50 TF | | Control D-50 TF | |
|---|---|---|---|---|
| | DHA | SHA | DHA | SHA |
| 600 rpm | 73 | 83 | 71 | 75 |
| 300 rpm | 42 | 48 | 43 | 45 |
| 200 rpm | 31 | 36 | 32 | 33 |
| 100 rpm | 19 | 23 | 21 | 21 |
| 6 rpm | 5 | 8 | 5 | 8 |
| 3 rpm | 4 | 7 | 4 | 7 |
| PV | 31 | 35 | 28 | 30 |
| YP | 11 | 13 | 15 | 15 |
| 10-sec gel | 6 | 10 | 6 | 11 |

TABLE 3-continued

| | Jet Milled D-50 TF | | Control D-50 TF | |
|---|---|---|---|---|
| | DHA | SHA | DHA | SHA |
| 10-min gel | 12 | 22 | 12 | 16 |
| Electrical Stability | 2048 | 1200 | 1999 | 1150 |
| Separated Top Oil | — | 26 | — | 21 |
| Bottom ~75 mL Density | — | 17.55 | — | 17.97 |
| Aggregate Density | — | 16.50 | — | 16.58 |
| Density Variation | — | 1.05 | — | 1.39 |

The Rheology parameters remained comparably consistent between the two treatment fluids, varying only by about 10% at the most. Heat aging resulted in a gradient of fluid density in the pressurized testing cells, which is typical since the cells are capable of high temperatures but only limited pressure. Accordingly, the jet milled operational oilfield particulates described herein can be employed in a treatment fluid for use in a subterranean formation operations without compromising, or even enhancing, the function of the treatment fluid.

Example 2: In this example, the ability of jet milled crude oilfield particulates of barite having 90% thereof (D-90) with unit mesh size of 42.8 μm were evaluated for their use in a treatment fluid. The crude oilfield particulates were first ground to form operational oilfield particulates using three rotor speeds of the jet mill: a rotor speed of 8500 revolutions per minute (rpm), a rotor speed of 2800 rpm, and a rotor speed of 2000 rpm, which produced reduced sized barite as shown in Table 4 below.

TABLE 4

| Rotor Speed | Crude Oilfield Particulates (D-90 μm) | Operational Oilfield Particulates (D-90 μm) |
|---|---|---|
| 8500 rpm | 42.8 | 2.4 |
| 2800 rpm | 42.8 | 6.6 |
| 2000 rpm | 42.8 | 7.3 |

As shown in Table 4, and similarly shown in Table 1 in Example 1, the sizes of the operational oilfield particulates can be fine-tuned using at least the rotor speed of the jet mill described herein. As comparison, a traditional stationary mill, as described above, was used to grind the crude oilfield particulates and a D-90 of 6.0 was achieved, demonstrating the similar effectiveness of traditional stationary mills and jet mills, at least at low rotor speeds of the jet mills.

Therefore, the embodiments disclosed herein are well adapted to attain the ends and advantages mentioned as well as those that are inherent therein. The particular embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A system comprising:

a feed tank containing crude oilfield particulates having a first average unit mesh size;

a jet mill fluidly coupled to the feed tank by a feed conveyance configured to conveying the crude oilfield particulates to the jet mill, wherein the jet mill reduces a size of the crude oilfield particulates to a second average unit mesh size that is smaller than the first average unit mesh size, thereby forming particulates for subterranean oilfield operations;

an output conveyance fluidly coupled to the jet mill configured to conveying the particulates for subterranean oilfield operations from the jet mill to a target location comprising a fluid stream entering a wellbore.

2. The system of claim 1, wherein the target location further comprises a storage tank, a mixing tank, a fluid line, a conveyor belt, a bag filler, or any combination thereof.

3. The system of claim 1, wherein the jet mill is immobile relative to the feed tank.

4. The system of claim 1, wherein the jet mill is portable relative to the feed tank.

5. The system of claim 1, wherein at least the jet mill is containerized and portable.

6. The system of claim 1, wherein the system is located at a wellsite or at a mixing facility.

7. The system of claim 1, wherein the first average unit mesh size of the crude oilfield particulates is in the range of 25 micrometers to 1.1 millimeters.

8. The system of claim 1, wherein the second average unit mesh size of the operational oilfield particulates is in the range of 0.5 micrometers to 20 micrometers.

9. The system of claim 1, wherein the jet mill has a processing rate of reducing the size of the oilfield particulates to the second unit mesh size that is smaller than the first unit mesh size to forming operational oilfield particulates of greater than 200 kilograms per hour.

10. A method comprising:

providing a jet mill;

conveying crude oilfield particulates from a feed tank to the jet mill by a feed conveyance fluidly coupling the feed tank and the jet mill, wherein the crude oilfield particulates have a first average unit mesh size;

reducing a size of the crude oilfield particulates, using the jet mill, to a second average unit mesh size that is smaller than the first average unit mesh size, thereby forming particulates for subterranean oilfield operations;

conveying the particulates for subterranean oilfield operations from the jet mill to a first target location by an output conveyance fluidly coupled to the jet mill;

preparing a fluid for subterranean oilfield operations comprising the particulates for subterranean oilfield operations; and conveying the prepared fluid to a second target location, wherein the second target location comprises a fluid stream entering a wellbore.

11. The method of claim 10, wherein the first target location is selected from the group consisting of a storage tank, a mixing tank, a fluid line, a conveyor belt, a bag filler, and any combination thereof.

12. The method of claim 10, wherein the jet mill is immobile relative to the feed tank.

13. The method of claim 10, wherein the jet mill is portable relative to the feed tank.

14. The method of claim 10, wherein at least the jet mill is containerized and portable.

15. The method of claim 1, wherein the system is located at a wellsite or at a mixing house facility.

16. The method of claim 10, wherein the first average unit mesh size of the crude oilfield particulates is in the range of 25 micrometers to 1.1 millimeters.

17. The method of claim 10, wherein the second average unit mesh size of the operational oilfield particulates is in the range of 0.5 micrometers to 20 micrometers.

18. The method of claim 10, wherein the jet mill has a processing rate of reducing the size of the oilfield particulates to the second unit mesh size that is smaller than the first unit mesh size to forming operational oilfield particulates of greater than 200 kilograms per hour.

19. A method comprising:

providing a jet mill;

conveying a weighting agent having a first average particle size from a feed tank to the jet mill by a feed conveyance fluidly coupling the feed tank and the jet mill, selecting a second average particle size based on a condition within a subterranean formation;

reducing a size of the weighting agent, using the jet mill, to the second average particle size that is smaller than the first average particle size, thereby forming particulates for subterranean oilfield operations, wherein the oilfield operation is a drilling operation;

conveying the particulates for subterranean oilfield operations from the jet mill to a target location by an output conveyance fluidly coupled to the jet mill;

preparing a drilling fluid comprising the particulates for subterranean oilfield operations; and conveying the prepared fluid to a fluid stream entering a wellbore.

20. The method of claim 19 wherein, the first average unit mesh size of the crude oilfield particulates is in the range of 25 micrometers to 1.1 millimeters and wherein the second average unit mesh size of the operational oilfield particulates is in the range of 0.5 micrometers to 20 micrometers.

* * * * *